United States Patent [19]

Miyanagi et al.

[11] 4,403,890

[45] Sep. 13, 1983

[54] METHOD OF LAYING PIPE UNDERGROUND AND SYSTEM THEREFOR

[75] Inventors: Naoki Miyanagi, Chiyodamura; Kojiro Ogata, Ishioka, both of Japan

[73] Assignee: Hitachi Construction Machinery Co., Ltd., Tokyo, Japan

[21] Appl. No.: 355,107

[22] Filed: Mar. 5, 1982

[30] Foreign Application Priority Data

Mar. 9, 1981 [JP] Japan ..... 56-32449

[51] Int. Cl.[3] ..... F16L 1/00; E21B 3/06

[52] U.S. Cl. ..... 405/184; 173/10; 175/27

[58] Field of Search ..... 405/184, 154, 182; 175/25–27, 62; 173/10

[56] References Cited

U.S. PATENT DOCUMENTS

| | | | |
|---|---|---|---|
| 1,718,430 | 6/1929 | Osgood | 173/10 |
| 2,271,025 | 1/1942 | Noble | 173/10 |
| 2,823,898 | 2/1958 | Bankston | 405/184 X |
| 3,155,171 | 11/1964 | Kurt et al. | 175/27 X |
| 3,385,376 | 5/1968 | Hobhouse | 175/27 X |
| 3,407,886 | 10/1968 | Bennett | 175/27 |
| 3,550,698 | 12/1970 | Pauley | 175/62 X |
| 3,945,442 | 3/1976 | Amtsberg | 173/10 |
| 3,971,449 | 7/1976 | Nylund et al. | 175/27 |
| 4,146,347 | 3/1979 | Woods | 405/184 |

FOREIGN PATENT DOCUMENTS

| | | | |
|---|---|---|---|
| 649812 | 2/1979 | U.S.S.R. | 175/27 |

*Primary Examiner*—Dennis L. Taylor

*Attorney, Agent, or Firm*—Antonelli, Terry & Wands

[57] ABSTRACT

A method of and a system for laying a pipe underground wherein a head attached to the leading end of the pipe to be laid underground is caused to move in vibratory movement while a propelling force is exerted on the rear end of the pipe to obtain penetration of the earth by the pipe. While the head is forced to move ahead by the propelling force exerted on the rear end of the pipe, the vibration of the head is measured. When the vibration drops in magnitude, the propelling force is decreased to reduce the speed at which the head is forced to move ahead; so as to cause restoration of the vibration to the original level, and when the vibration rises, the propelling force is increased to increase the speed at which the head is forced to move ahead.

5 Claims, 7 Drawing Figures

METHOD OF LAYING PIPE UNDERGROUND AND SYSTEM THEREFOR

BACKGROUND OF THE INVENTION

This invention relates to a method of laying a pipe underground and a system for carrying such method into practice.

In one method known in the art which is usually used for laying a pipe underground, the ground is excavated to form a groove in a position in which the pipe is to be laid, and one pipe after another is placed in the groove. This method is generally referred to as an open channel process in which it is necessary that a groove be dug deep below the surface of the ground when it is desired to lay a pipe deep underground, and this is not desirable because the operation is time-consuming. When the open channel process is used, difficulties are faced with particularly if the pipe is designed to be laid under the buildings. Methods known in the art to replace the open channel process includes a propulsion process in which a starting pit is dug and a pipe is made to penetrate the ground on the side of the pit by means of propelling cylinders while pipe segments are being connected together to form the pipe. The propulsion process has become a main process in laying pipes of a diameter below 800 mm. In the propulsion process, a multiplicity of pipe segments are connected together and driven through the earth by propulsion. Thus a high earth pressure would be applied to the lateral surface of the pipe assembly to offer high frictional resistance or adhesion resistance. Also, high resistance would be offered by the earth acting on the front surface of the head attached to the leading end of the pipe to the movement of the pipe through the ground. Thus a very high propelling force would be required to carry out pipe laying operation by the propulsion process, thereby entailing the use of a propulsion system of large size.

SUMMARY OF THE INVENTION

Accordingly this invention has as its object the provision of a novel propulsion process capable of laying a pipe with a propelling force that is lower than the propelling force used in the prior art to carry out pipe laying and a system suitable for carrying such process into practice.

One of the aspects of the present invention is that a head attached to the leading end of a pipe is caused to vibrate to thereby reduce the resistance offered by the earth and also to form a gap between the lateral surface of the pipe and the earth to reduce the resistance offered by the earth to lateral surface of the pipe.

Another aspect is that the vibration of the head is measured at all times and the propelling force exerted on the trailing end of the pipe is reduced when the vibration of the head decreases and increased when the vibration of the head increases. During movement of the head through the earth, a change in the nature of the earth would cause the magnitude of the vibration to vary. When the force tending to restrain the vibration of the head is high, the vibration of the head decreases. When this is the case, the propelling force is reduced to cause the propelling speed to drop to thereby keep the head from being stuck in the ground. When the earth tending to restrain the vibration of the head is low, the vibration of the head increases. In such case, the propelling force is increased to cause the propelling speed to rise. Thus the vibration of the head is effectively utilized at all times to enable propulsion of the pipe to be obtained smoothly.

In a preferred embodiment of the invention, an accelerometer is mounted in the head to measure and indicate the magnitude of the vibration of the head at all times on the basis of changes caused to occur in the acceleration of the head.

Additional and other objects, features and advantages of the present invention will become apparent from the description set forth hereinafter when considered in conjunction with the accompanying drawings.

DETAILED DESCRIPTION OF THE PREFERRED EMBODIMENT

Figure 1:
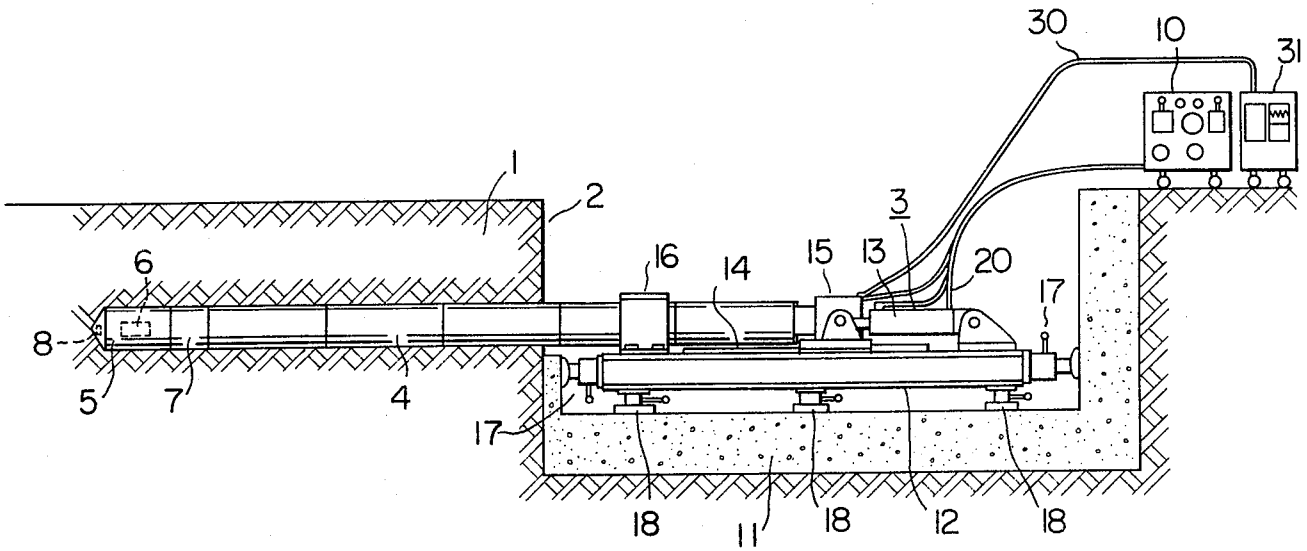
FIG. 1 is a side view of the system for laying a pipe comprising one embodiment of the invention.

Referring to FIG. 1, a vibration type pipe laying system suitable for carrying into practice the propulsion process according to the invention comprises a pipe propelling device 3 arranged in a starting pit 2, and a head 5 and a vibration damper 7 connected to the leading end of a pipe 4 to be forced into the earth 1 and laid underground. The head 5 has mounted therein an exciter 6 and a vibrometer 8 subsequently to be described. The pipe 4 is composed of a plurality of pipe segments axially connected together.

The pipe propelling device 3 comprises a base 12, propelling cylinders 13 located on the base 12, rails 14, a presser ring 15 slidably guided on the rails 14 to apply the propelling force generated by the propelling cylinders 13 to the trailing end of the pipe 4, and a guide 16 securedly fixed to the base 12 for guiding the pipe 4. The base 12 further has secured thereto manually-operated jacks 17 and 18 for securedly holding the base 12 on a concrete frame 11 on the inner surface of the pit 2. The propelling cylinders 13 are hydraulic cylinders connected to a hydraulic pressure fluid supply unit 10 through hydraulic fluid hoses 20.

Figure 2:
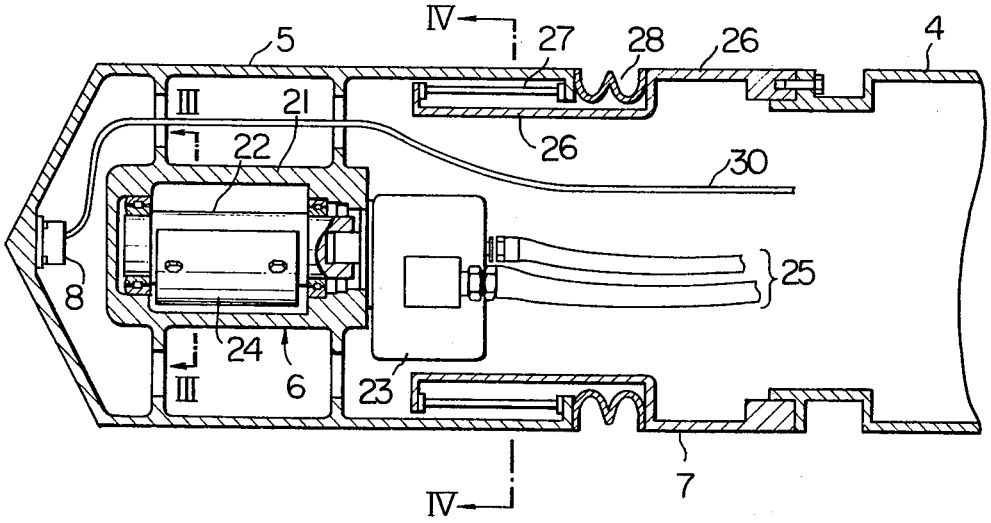
FIG. 2 is a sectional view, on an enlarged scale, of the head and the vibration absorber attached to the leading end of the pipe laid underground.
Figure 3:
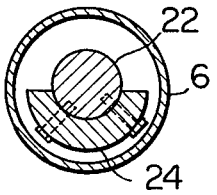
FIG. 3 is a sectional view taken along the line III—III in FIG. 2.

FIG. 2 shows on an enlarged scale the head 5 which is a hollow cylindrical member formed at its front surface with a pointed end to facilitate penetration of the earth by the head 5. The exciter 6 mounted in the head 5 comprises a housing 21 secured to the head 5, a rotary shaft 22 rotatably supported by the housing 21 and a hydraulic motor 23 supported by the rotary shaft 22 and driven for rotation. The rotary shaft 22 has mounted thereon an eccentric weight 24. The rotary shaft 22 is positioned such that its axis substantially coincides with the center axis of the head 5, while the eccentric weight 24 is located in a position such that its center of gravity is displaced from the axis of the rotary shaft 22 as shown in FIG. 3. Thus rotation of the rotary shaft 22 causes centrifugal forces to be exerted on the eccentric weight 24 mounted on the rotary shaft 22, to thereby cause the shaft 22 to move in vibratory movement and the head 5 to move in orbiting movement. The hydraulic motor 23 is connected to the hydraulic pressure fluid supply source 10 through hydraulic fluid hoses 25.

Figure 4:
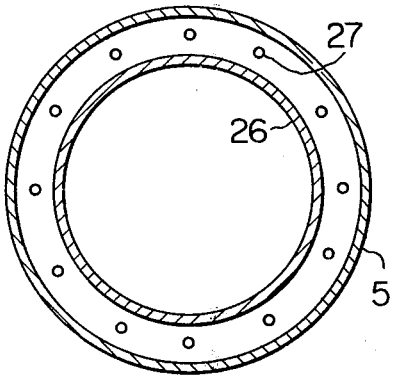
FIG. 4 is a sectional view taken along the line IV—IV in FIG. 2.

The vibration damper 7 has the function of keeping as much as possible the vibratory movement or orbiting movement of the head 5 from being transmitted to the pipe 4. The vibration damper 7 comprises a tubular member 26 connected to the leading end of the pipe 4, a plurality of rods 27 connected at one end to the cylindrical member 26 and at the other end to the head 5, and a flexible seal member 28 for keeping earth from entering the interior of the pipe 4. As shown in FIG. 4, the plurality of rods 27 are arranged substantially equidistantly from one another circumferentially of the head 5 and extend axially thereof. The plurality of rods 27 arranged in this manner transmit to the head 5 a force exterted axially on the pipe 4 and accommodate transverse displacements of the head 5.

Figure 5:
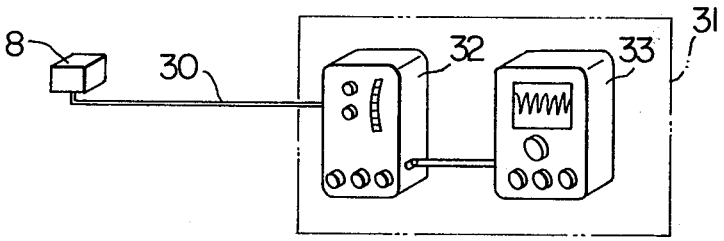
FIG. 5 is a perspective view of the vibrometer and the monitor panel.

Referring to FIG. 2, the vibrometer 8 is mounted at the forward end of the head 5. In this embodiment, the vibrometer 8 is in the form of a unidirectional sensitive accelerometer. The accelerometer 8 is connected through a signal line 30 to an amplifier 32 on a monitor panel 31 and then to an indicator 33 which may, for example, be a cathode-ray oscilloscope (see FIG. 5). The indicator 33 gives an indication in the form of a curve of changes in the acceleration that are measured by the accelerometer 8. The acceleration of the head 5 being a factor concerned in the magnitude of the vibration thereof, it is possible to monitor the magnitude of the vibration by monitoring the acceleration of the head 5. In place of the acceleration of the head 5 indicated in the form of a curve, the amplitude of vibration of the head 5 may be obtained by calculation and indicated. Any other suitable known means may be used for obtaining measurements of the vibration of the head 5.

Figure 6:
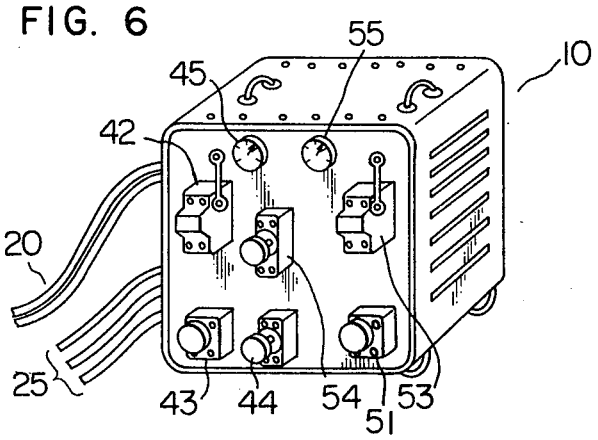
FIG. 6 is a perspective view of the hydraulic pressure fluid supply unit.
Figure 7:
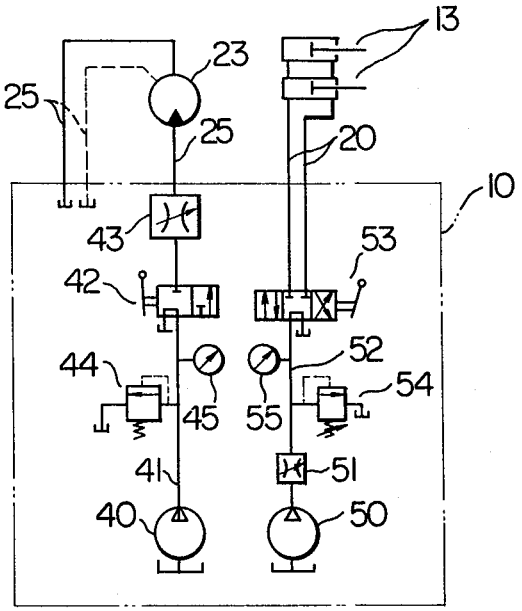
FIG. 7 is a diagram of the hydraulic fluid circuit.

Referring to FIGS. 6 and 7, the hydraulic pressure fluid supply unit 10 comprises hydraulic pumps 40 and 50. The hydraulic pump 40 is connected through a passage 41, a manually-operated directional control valve 42, a flowate control valve 43 and the hydraulic fluid hose 25 to the hydraulic motor 23 of the exciter 6. The passage 41 mounts a circuit pressure setting relief valve 44 and a pressure gauge 45. The hydraulic pump 50 is connected through a flowrate control valve 51, a passage 52, a manually-operated directional control valve 53 and the hydraulic fluid hose 20 to the propelling cylinders 13. The passage 52 mounts a variable relief valve 54 and a pressure gauge 55.

Operation of the embodiment of the aforesaid construction will be described by referring to FIGS. 1 and 7. Actuation of the control valve 42 feeds a supply of hydraulic pressure fluid from the pump 40 to the hydraulic motor 23, to thereby actuate the exciter 6. The exciter 6 causes the head 5 to move in lateral vibratory movement or orbiting movement. While the head 5 is moving in orbiting movement, the control valve 53 is actuated to render the propelling cylinders 13 operative, to thereby exert a propelling force on the pipe 4. The propelling force exerted by the propelling cylinders 13 on the pipe 4 forces the latter into the earth. The orbiting movement of the head 5 causes a gap to be formed between the lateral surface of the pipe 4 and the earth, so that the firctional force and adhesive force exerted by the earth 1 on the lateral surface of the pipe 4 and the head 5 can be reduced. Thus the resistance offered by the earth 1 to the lateral surface of the pipe 4 and head 5 can be reduced and the resistance offered by the earth 1 to the leading end of the head 5 can also be reduced. This enables the pipe 4 to be propelled through the earth 1 with a low propelling force.

In case an excessively high propelling force is exerted on the head 5, the speed of the head 5 would become too high and the head 5 would be trapped in the earth 1. This would cause a reduction in the lateral vibration of the head 5. In addition, it is possible that the lateral vibration of the head 5 may be reduced due to a change in the nature of the earth 1, while the head 5 is propelled through the earth 1. The reduction of the vibration would cause a reduction in formation of a gap between the lateral surface of the pipe 4 and the earth 1 so that the reduction in the propelling force would not be expected. Thus, the reduction of the vibration of the head 5 must be prevented. According to the present embodiment, the vibration of the head 5 is monitored by means of the indicator 33. The propelling force exerted by the propelling cylinder 13 is reduced when the vibration of the head 5 decreases. A reduction in the propelling force exerted by the propelling cylinders 13 can be achieved by operating the flowrate control valve 51, variable relief valve 54 and directional control valve 53 either singly or in a suitable combination. A reduction in the propelling force exerted by the propelling cylinder 13 results in a drop in the penetrating speed of the head 5, so that the head 5 can be kept from being stuck in the earth 1 and having its vibration damped. In addition, a reduction in the propelling force exerted by the propelling cylinders 13 enables the vibration of the head 5 to be restored to its original level. Meanwhile when the vibration of the head 5 is large, the propelling force exerted by the propelling cylinders 13 is increased to thereby increase the head propelling speed. In this way, the pipe 4 can be made to penetrate the earth by the propelling force exerted by the propelling cylinders 13 by effectively utilizing the vibration of the head 5.

In the foregoing description, the propelling force exerted by the propelling cylinders 13 on the pipe 4 is manually adjusted while the magnitude of the vibration of the head 5 is monitored by the operator by the naked eye. It is to be understood, however, that the invention is not limited to this specific form of embodiment and that the system may be made to automatically respond to changes in the magnitude of the vibration of the head 5 to vary the propelling force exerted by the propelling cylinder 13 on the pipe 4. Also, in the foregoing description, the head 5 has been described as moving in lateral vibratory movement or orbiting movement. However, the invention is not limited to this specific form of vibration of the head 5 and the head 5 may be moved in lengthwise vibratory movement.

What is claimed is:

1. A method of laying a pipe underground wherein the pipe to be laid underground has attached to its leading end a head formed at its front surface with a pointed end to facilitate penetration of the earth and has a propelling force exerted on its rear end so as to obtain penetration of the earth by the pipe, characterized by the steps of:

causing said head to move in vibratory movement, measuring the vibration of the head; and increasing the propelling force exerted on the pipe when the magnitude of the vibration of the head is high and decreasing the propelling force when the magnitude of the vibration of the head is low.

2. A method as claimed in claim 1, wherein the vibration of the head is measured by an accelerometer mounted in the head.

3. A pipe laying system including a head attached to the leading end of a pipe to be layed underground and formed at its front surface with a pointed end to facilitate penetration of the earth, and propelling means for exerting a propelling force on the rear end of the pipe to be laid underground; wherein the improvement comprises:

means for causing said head to move in vibratory movement;

vibration damping means interposed between said head and the pipe to be laid underground;

means for measuring the vibration of said head; and means for effecting adjustments of the propelling force exerted on the rear end of the pipe to be laid underground.

4. A pipe laying system as claimed in claim 3, further comprising an indicator for indicating the vibration of the head.

5. A pipe laying system as claimed in claim 3 or 4, wherein said measuring means comprises an accelerometer mounted in the head.

* * * * *